US007516697B2

(12) United States Patent
Nakaya et al.

(10) Patent No.: US 7,516,697 B2
(45) Date of Patent: Apr. 14, 2009

(54) SINGLE COLOR PRESS AND METHOD OF OPERATING SAME, AND METHOD OF MANUFACTURING LIQUID CRYSTAL COLOR FILTER

(75) Inventors: Yoshinori Nakaya, Hiroshima-ken (JP); Ryojiro Katsube, Hiroshima-ken (JP)

(73) Assignee: Mitsubishi Heavy Industries, Ltd, Tokyo (JP)

( * ) Notice: Subject to any disclaimer, the term of this patent is extended or adjusted under 35 U.S.C. 154(b) by 490 days.

(21) Appl. No.: 11/337,152

(22) Filed: Jan. 23, 2006

(65) Prior Publication Data

US 2006/0162594 A1 Jul. 27, 2006

(30) Foreign Application Priority Data

Jan. 26, 2005 (JP) ..... 2005-018865

(51) Int. Cl.
*B41F 11/00* (2006.01)

(52) U.S. Cl. ..... 101/215; 101/214

(58) Field of Classification Search ..... 101/215, 101/214
See application file for complete search history.

(56) References Cited

U.S. PATENT DOCUMENTS 4,479,432 A * 10/1984 Masaki et al. ..... 101/170
5,343,803 A * 9/1994 Duchek et al. ..... 101/35
5,367,953 A * 11/1994 Yamashita et al. ..... 101/158
5,533,447 A * 7/1996 Johnson et al. ..... 101/211
7,140,296 B2 * 11/2006 Baek et al. ..... 101/170
7,243,599 B2 * 7/2007 Yoo et al. ..... 101/170

FOREIGN PATENT DOCUMENTS

| | | | |
|---|---|---|---|
| JP | 10-095093 | | 4/1998 |
| JP | 10-166543 | A | 6/1998 |
| JP | 11-58921 | | 3/1999 |
| JP | 11-198337 | A | 7/1999 |
| JP | 2002-347204 | | 12/2002 |
| JP | 3402974 | B2 | 5/2003 |
| JP | 3434143 | B | 8/2003 |
| JP | 3689536 | B2 | 8/2005 |
| JP | 3730002 | B2 | 12/2005 |

* cited by examiner

*Primary Examiner*—Anthony H. Nguyen
(74) *Attorney, Agent, or Firm*—Kanesaka Berner & Partners, LLP

(57) ABSTRACT

An object is to provide a single color press which shortens takt time by eliminating wastefulness from the printing process. There is provided: a first transfer cylinder which transfers an image to a first printing substrate; a first moving carriage which holds the first transfer cylinder in a rotatable manner and travels along a frame; a second transfer cylinder which transfers an image of the same color and shape to a second printing substrate; a second moving carriage which holds the second transfer cylinder in a rotatable manner and travels along the frame 3; and a single relief plate which removes a reverse image from ink applied to the first transfer cylinder and the second transfer cylinder.

4 Claims, 4 Drawing Sheets

SINGLE COLOR PRESS AND METHOD OF OPERATING SAME, AND METHOD OF MANUFACTURING LIQUID CRYSTAL COLOR FILTER

BACKGROUND OF THE INVENTION

1. Technical Field of the Invention

The present invention relates to a single color press which prints an identical image of the same color and shape onto a plurality of printing substrates placed on a frame, and a method of operating such a single color press.

A "Single color press" herein means a printing press for printing a single-layer image, which may be colored or colorless, on a printing substrate.

2. Description of Related Art

A flatbed press is one known method of forming the image of a flat panel display such as a liquid crystal display, plasma display, or EL (Electro Luminescence) display, on a flat glass substrate or a ceramic substrate.

As described in patent documents 1 and 2, a desired image is printed with a flatbed press by placing a flat plate on which a reverse image is formed, on a flat bed together with a flat printing substrate, and for example in the case of reverse printing, removing the ink that corresponds to the reverse image formed on the plate from the ink applied to the outer surface of a transfer cylinder, and transferring the image remaining on the transfer cylinder onto the printing substrate.

In Japanese Patent No. 3402974 (documents 1) and Japanese Patent No. 3434143 (documents 2) , single color presses are disclosed which reduce takt time by supporting two transfer cylinders in a rotatable manner on one moving carriage, and having each transfer cylinder in succession transfer an identical image of the same color and shape onto a printing substrate corresponding to that cylinder.

However, with the printing machines disclosed in patent documents 1 and 2, providing two transfer cylinders on a single moving carriage means that when transfer takes place from one of the transfer cylinders to one of the printing substrates, the other transfer cylinder also moves with the moving carriage, which forces unnecessary movement of the transfer cylinder that is not transferring to a printing substrate. This introduces dead time into the printing process and prevents takt time from being reduced.

The present invention takes into consideration the above circumstances, with an object of providing a single color press which shortens takt time by eliminating wastefulness from the printing process.

In order to solve the above problems, the single color press and operation method of the present invention employ the following measures.

That is, the single color press according to the present invention comprises: a first transfer cylinder which transfers an image to a first printing substrate; a first moving carriage which holds the first transfer cylinder in a rotatable manner and travels along a frame; a second transfer cylinder which transfers an image of the same color and shape as that of the image to a second printing substrate; and a second moving carriage which holds the second transfer cylinder in a rotatable manner and travels along the frame.

Since the first moving carriage and the second moving carriage are provided independently, printing can be performed by moving each transfer cylinder to transfer the image to the corresponding printing substrate, without being restricted by the movement of the other transfer cylinder. Thus, because each transfer cylinder is not forced to move together with the other transfer cylinder, wasted movement of the transfer cylinders can be all but eliminated. Accordingly, takt time can be shortened even more.

In addition, the single color press according to the present invention comprises a single plate which removes a reverse image from ink applied to the first transfer cylinder and the second transfer cylinder.

Because one such plate is provided, and this plate is used in common by the first transfer cylinder and the second transfer cylinder, printing onto two printing substrates can be executed using the one plate. Accordingly, equipment cost is lower than if two plates were provided.

Particularly in applications where the plate is mounted on top of a platen, because a common platen is used with each printing substrate, then only one alignment adjusting device for positioning the alignment of the platen with respect to the image printed on the platen and the printing substrate, and only one plate cleaning device is needed. Accordingly, the equipment cost can be further reduced.

Here, a "reverse image" means an image where the positive and negative regions are reversed with respect to the image to be printed on the printing substrates, and does not mean an image where the left and right or top and bottom directions have been reversed with respect to the image to be printed on the printing substrates.

In addition, in the single color press according to the present invention, when the first transfer cylinder is moved to a position of the first printing substrate after a reverse image is removed from the first transfer cylinder by the plate, the second transfer cylinder is moved from behind the first transfer cylinder to a position above the plate, and while the first transfer cylinder is transferring an image to the first printing substrate, a reverse image is removed from the second transfer cylinder by the plate.

By using a construction in which the second transfer cylinder moves from behind the first transfer cylinder to a position above the plate, removal of the reverse image by the plate can be performed successively without any wasted time.

Because the reverse image is removed from the second transfer cylinder by the plate, while the first transfer cylinder is transferring the image to the first printing substrate, the printing process can proceed without any waste of time, and takt time can be shortened.

Moreover, in the single color press according to the present invention, one coating device which applies ink to the first transfer cylinder and the second transfer cylinder is provided.

Because only one coating device is provided, the equipment cost can be reduced.

Furthermore, the single color press according to the present invention comprises; a first plate which removes a reverse image from the first transfer cylinder, and a second plate which removes a reverse image from the second transfer cylinder, and the first printing substrate and the second printing substrate are placed on a common printing platen during printing, and the first plate and the second plate are respectively provided on either side of the printing platen.

Because the first printing substrate and the second printing substrate are placed on a common printing platen, only one device for handling the printing substrates, and one alignment adjusting device for the printing platen are required.

Furthermore, because the first plate and the second plate are provided on either side of the printing platen, the first moving carriage and the second moving carriage can access the plates from both sides, and the carriages do not interfere with each other. Accordingly, takt time can be shortened.

Moreover, in the single color press according to the present invention, when transferring to the first printing substrate, alignment adjustment of the first plate is performed with respect to the printing platen, and when transferring to the second printing substrate, alignment adjustment of the second plate is performed with respect to the printing platen.

Because the alignment of the printing platen is different for each plate, adjustment is to the alignment of the plate corresponding to the printing substrate to which transfer is next performed. This enables precise printing.

In the case of a construction where the plate is placed on the platen, the plate alignment adjusting device adjusts the alignment of the plate by moving the platen.

In addition, in the single color press according to the present invention, the alignment of the second plate is adjusted so as to match the alignment of the printing platen with respect to the first plate.

Because the alignment of the printing platen with respect to the first plate is matched to the alignment of the printing platen with respect to the second plate, there is no need to change the alignment of the printing platen every time the printing substrate is set. Consequently, there is no need to distinguish between used platens every time printing is performed, which reduces the complexity of printer control and management.

Furthermore, a method of operating a single color press according to the present invention is a method of operating a single color press comprising: a first transfer cylinder which transfers an image to a first printing substrate; a first moving carriage which holds the first transfer cylinder in a rotatable manner and travels upon a frame; a second transfer cylinder which transfers an image of the same color and shape as that of the image to a second printing substrate; a second moving carriage which holds the second transfer cylinder in a rotatable manner and travels upon the frame; and a single plate which removes a reverse image from ink applied to the first transfer cylinder and the second transfer cylinder, wherein when the first transfer cylinder is moved to a position of the first printing substrate after a reverse image is removed from the first transfer cylinder by the plate, the second transfer cylinder is moved from behind the first transfer cylinder to a position above the plate, and while the first transfer cylinder is transferring an image to the first printing substrate, a reverse image is removed from the second transfer cylinder by the plate.

Because the transfer cylinder moves from behind the first transfer cylinder to a position above the plate, removal of the reverse image by the plate can be performed without any wasted time.

Because the reverse image is being removed from the second transfer cylinder while the first transfer cylinder is transferring the image to the first printing substrate, the printing process can proceed without any waste of time, and takt time can be shortened.

Furthermore, a method of operating a single color press according to the present invention is a method of operating a single color press comprising: a first transfer cylinder which transfers an image to a first printing substrate; a first moving carriage which holds the first transfer cylinder in a rotatable manner and travels upon a frame; a second transfer cylinder which transfers an image of the same color and shape as that the image to a second printing substrate; a second moving carriage which holds the second transfer cylinder in a rotatable manner and travels upon the frame; a first plate which removes a reverse image from the first transfer cylinder; and a second plate which removes a reverse image from the second transfer cylinder, in which the first printing substrate and the second printing substrate are each placed on the same printing platen during printing, wherein the first plate and the second plate are respectively provided on either side of the printing platen, the first moving carriage is moved from a position of the first plate towards the printing platen, and the second moving carriage is moved from a position of the second plate towards the printing platen.

Furthermore, in a method of manufacturing a liquid crystal color filter according to the present invention, a plurality of any of the above types of single color presses are provided, and images in at least R, G, and B ink are sequentially transferred to the first printing substrate and the second printing substrate.

In addition, a plurality of any of the above types of single color presses may be provided, and images in black matrix (light shielding film), R, G, and B ink may be sequentially transferred to the first printing substrate and the second printing substrate.

Furthermore, in the method of manufacturing a liquid crystal color filter according to the present invention, the method of operating any of the above types of single color presses is used to sequentially transfer images in at least R, G, and B ink to the first printing substrate and the second printing substrate.

In addition, the method of operating any of the above types of single color presses may be used to sequentially transfer images in black matrix (light shielding film), R, G, and B ink to the first printing substrate and the second printing substrate.

The present invention has the following effects.

By placing the first plate and the second plate on the same printing platen, only one device for handling the printing substrates and one device for aligning the printing platen are required.

Furthermore, by providing the first plate and the second plate on either side of the printing platen, the first moving carriage and the second moving carriage can access the plates from both sides, and the moving carriages do not interfere with each other. Accordingly, takt time can be shortened.

DETAILED DESCRIPTION

Embodiments of the present invention are described below with reference to the drawings.

FIRST EMBODIMENT

A first embodiment of the present invention is described below with reference to FIG. 1 and FIG. 2.

Figure 1:
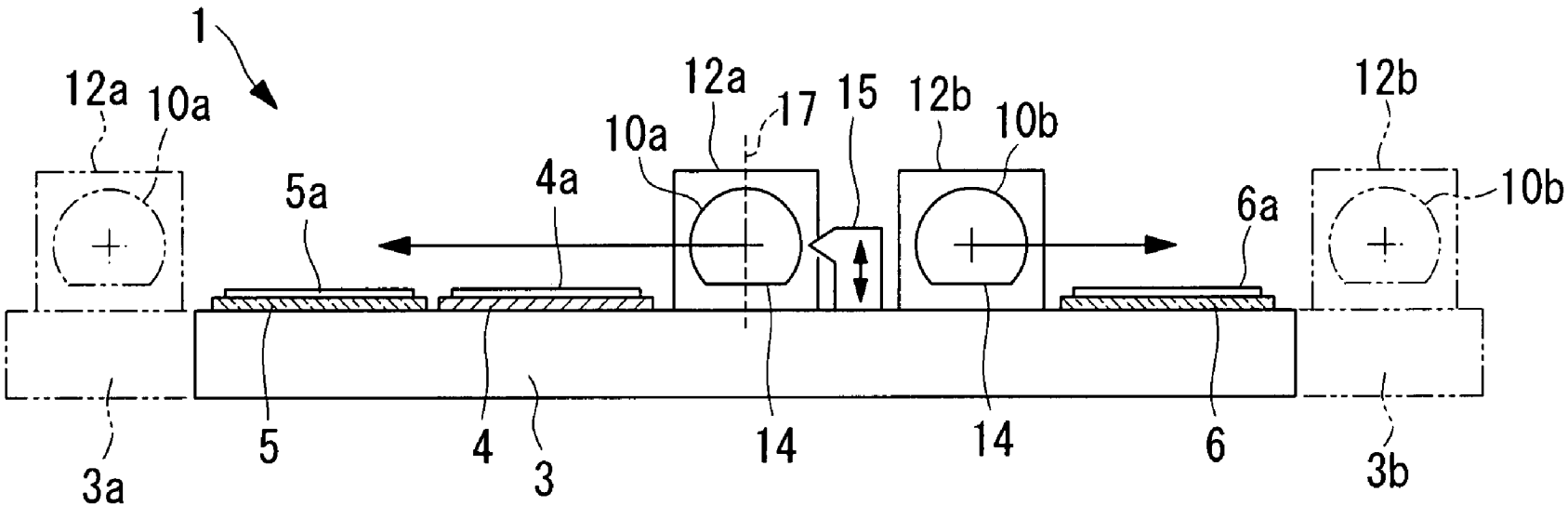
FIG. 1 is a front view showing an overview of a single color press according to a first embodiment of the present invention.

FIG. 1 shows a front view of a single color press 1 according to the present embodiment. The single color press 1 prints an identical image of the same color and shape onto a plurality of printing substrates. The single color press 1 of the present embodiment is a flat bed press.

The single color press 1 mainly comprises; a frame 3 having a flat bed in a horizontal plane, three platens 4, 5, and 6 mounted on this flat bed, two blanket cylinders (transfer cylinders) 10*a* and 10*b*, two moving carriages 12*a* and 12*b* which support the blanket cylinders 10*a* and 10*b* in a rotatable manner, and one coating device 15 which applies ink to the blanket cylinders 10*a* and 10*b*.

The frame 3 is secured onto a floor, and extends in the printing direction (the longitudinal direction in the figure). Running rails (not shown) are provided along the longitudinal direction on both sides of the frame 3, and the moving carriages 12*a* and 12*b* move back and forth along these running rails in the printing direction.

The three platens 4, 5, and 6 comprise; a platen 4, a first glass platen (printing platen) 5 provided closely adjacent to one side of the platen 4 (on the left in the figure) via a predetermined gap, and a second glass platen 6 provided on the other side of the platen 4 (on the right in the figure) with a space for an area where the moving carriages 12*a* and 12*b* and the coating device 15 are positioned.

The platen 4 is a flat plate, and on the top thereof is placed a relief plate (plate) 4*a*. Positioning of the relief plate 4*a* is performed according to markers formed on the platen 4. A reverse image which is the reverse of the desired final image, is formed on the surface of the relief plate 4*a*. As described below, relief portions which collectively form the reverse image, remove the ink from the blankets of the blanket cylinders 10*a* and 10*b*, the entire surfaces of which are coated with ink.

Here, a "reverse image" means an image where the positive and negative regions are reversed with respect to the image to be printed on the glass substrates 5*a* and 6*a*, and does not mean an image where the left and right or top and bottom directions are reversed with respect to the image to be printed on the glass substrates 5*a* and 6*a*.

The first and second glass platens 5 and 6 are flat plates, on the top of which are placed glass substrates (printing substrates) 5*a* and 6*a*. The glass substrates 5*a* and 6*a* are positioned to match with existing markers formed on the glass platens 5 and 6.

In the case of a liquid crystal color filter, in a first step in the printing process which is printing a black matrix, alignment adjustment for printing to the untreated glass is not performed. Positioning is performed as described above in the step where the R (red), G (green), and B (blue) inks are applied to the glass substrate on which the black matrix is printed.

For example, when manufacturing a liquid crystal color filter, the glass substrates 5*a* and 6*a* on which the black matrix is printed are positioned upon the glass platens 5 and 6, and the red ink image is transferred. The glass substrates 5*a* and 6*a* are then positioned upon the glass platens 5 and 6 of a second single color press 1, and the green ink image is transferred. Finally, the glass substrates 5*a* and 6*a* are positioned upon the glass platens 5 and 6 of a third single color press 1, and the blue ink image is transferred. In this manner, the red, green and blue ink images are transferred sequentially onto the glass substrates 5*a* and 6*a*, thereby manufacturing the color filter.

Furthermore, the ink image for the black matrix may also be transferred onto the glass substrates 5*a* and 6*a*.

The two moving carriages 12*a* and 12*b* are provided on the frame 3, and travel upon the frame 3 in the printing direction (the longitudinal direction in the figure). Before the ink is applied, the moving carriages 12*a* and 12*b* wait in a standby position between the platen 4 and the second glass platen 6, as shown in FIG. 1.

On the first moving carriage 12*a*, a first blanket cylinder 10*a* is provided in a rotatable manner, and on the second moving carriage 12*b*, a second blanket cylinder 10*b* is provided in a rotatable manner.

The blanket cylinders 10*a* and 10*b* are provided so that their axes of rotation are orthogonal to the traveling direction of the moving carriages 12*a* and 12*b*, and they roll over the relief plate 4*a* and the glass substrates 5*a* and 6*a* with travel of the moving carriages 12*a* and 12*b*.

On the blanket cylinders 10*a* and 10*b*, as shown in FIG. 1, are provided notches 14 where a portion is notched along the longitudinal direction. In these notches 14 is provided securing sections (not shown) which secure the opposite ends of the blankets wound around the blanket cylinders 10*a* and 10*b*. These notches 14 provide leeway so that when the blanket cylinders 10*a* and 10*b* pass over the platen 4 and the glass platens 5 and 6 without transferring an image, they can pass without coming into contact with the platens 4, 5 and 6.

The coating device 15 is a device which applies ink from the side to both the first blanket cylinder 10*a* and the second blanket cylinder 10*b*. As shown in FIG. 1, this coating device 15 is provided between the positions where the first blanket cylinder 10*a* and the second blanket cylinder 10*b* stand by before ink is applied. When the blanket cylinder 10*a* or 10*b* is located at a predetermined ink application position 17 (the position of the first blanket cylinder 10*a* in FIG. 1), ink can be applied to the entire surface of that blanket. In other words, the second blanket cylinder 10*b* moves to the ink application position 17 after the first blanket cylinder 10*a* has moved away from the ink application position 17, and ink is then applied to the second blanket cylinder 10*b* at that position.

During the period when ink is not being applied, the coating device 15 is stowed by moving downward to a level lower than the upper surface of the frame 3, and moves upward to the position shown in FIG. 1 only when applying ink. Accordingly, the coating device 15 does not interfere with the blanket cylinders 10*a* and 10*b* as they travel upon the frame 3.

Figure 2:
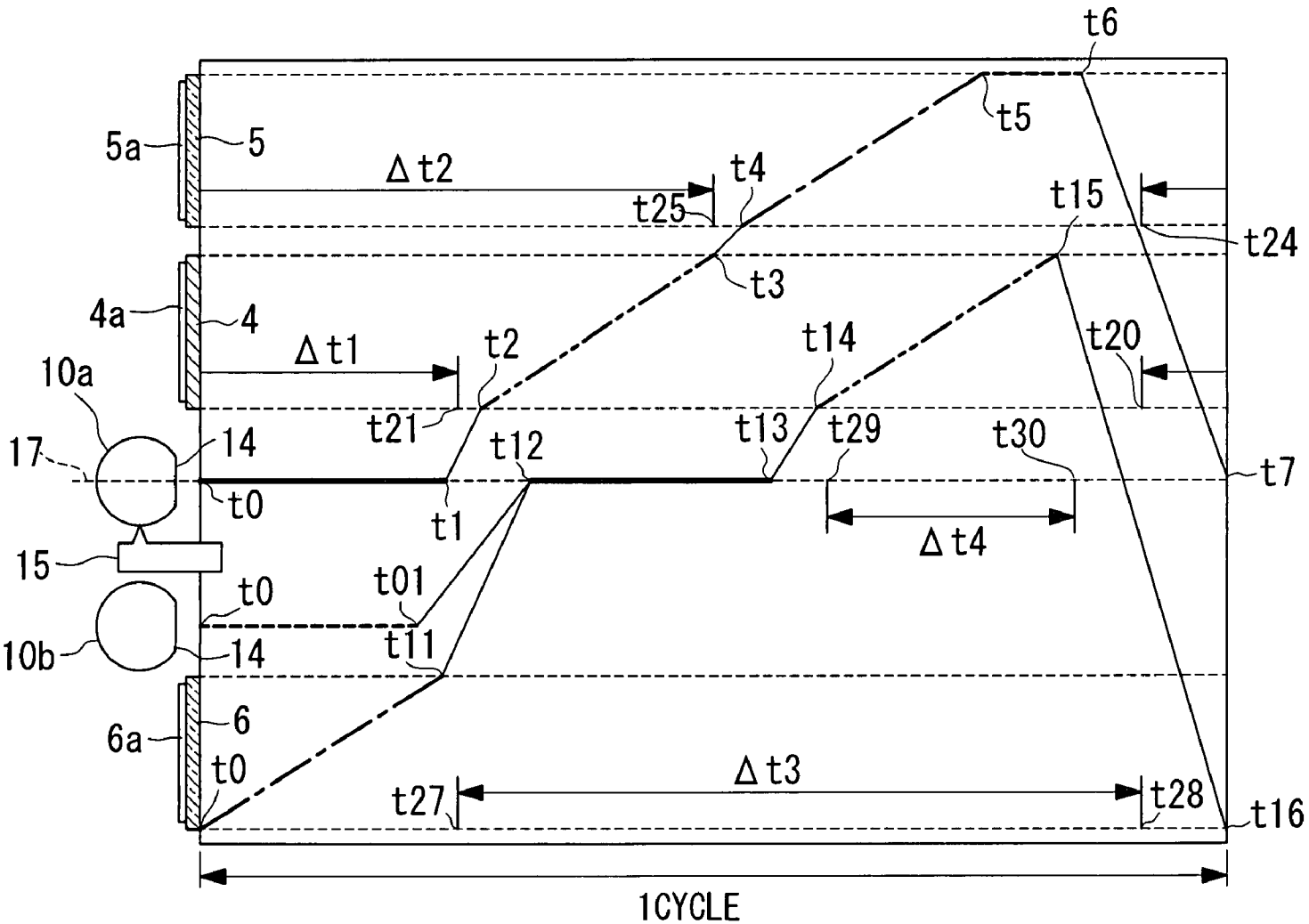
FIG. 2 is a time chart showing a method of operating the single color press shown in FIG. 1.

Next, the operation of the single color press 1 with this construction is described using FIG. 2.

In FIG. 2, the horizontal axis indicates time, and the vertical axis indicates position. The vertical axis shows the position of the platens 4, 5 and 6, the blanket cylinders 10*a* and 10*b*, and the coating device 15. Note that in the vertical axis in FIG. 2, the positional relationships (of the various elements) are reversed horizontally from those in FIG. 1.

First, the movement of the first blanket cylinder 10*a* is described. From time t0 to t1, the coating device 15 applies ink to the entire surface of the blanket of the first blanket cylinder 10*a* at the ink application position 17.

Subsequently, from time t1 to t2, the first blanket cylinder 10*a* is moved to a position above the platen 4, and from t2 to t3, ink transfer is performed between the relief plate 4*a* on the platen 4, and the first blanket cylinder 10*a*, thereby removing the ink from the image area corresponding to the reversed image, from the blanket.

After the transfer between the first blanket cylinder 10*a* and the relief plate 4*a* is completed at time t3, from time t3 to t4, the first blanket cylinder 10*a* is moved to a position above the first glass platen 5. Then, from time t4 to t5, the ink remaining on the blanket which corresponds to the image to be printed, is transferred onto the first glass substrate 5*a*, thereby printing the desired image onto the first glass substrate 5*a*.

At time t6, after the first blanket cylinder 10*a* has come to a stop near the furthest downstream position of the first glass platen 5 (the left side in FIG. 1), the first blanket cylinder 10*a* stops rotating, and in a state where the notch 14 is facing downward, the first blanket cylinder 10*a* is moved in the opposite direction by the first moving carriage 12*a*, returning to the initial position (the ink application position) at time t7.

Next, the movement of the second blanket cylinder 10*b* is described, in relation to the movement of the first blanket cylinder 10*a*.

When printing first begins, the second blanket cylinder 10*b* is stopped in a stand by position beside the coating device 15 from time t0 to t01. This is because at this time ink is being applied to the first blanket cylinder 10*a* at the ink application position 17.

From time t01 to t12, the second blanket cylinder 10*b* is moved from behind the first blanket cylinder 10*a* to the ink application position 17. As shown in FIG. 2, from time t1 to t2 the first blanket cylinder 10*a* is moving from the ink application position 17 towards the platen 4, and hence there is no interference between the blanket cylinders 10*a* and 10*b* even though the second blanket cylinder 10*b* moves to the ink application position 17.

Next, from time t12 to t13, the coating device 15 applies ink to the entire blanket surface of the second blanket cylinder 10*b* at the ink application position 17. While this is occurring, print transfer is performed between the first blanket cylinder 10*a* and the relief plate 4*a*.

The second blanket cylinder 10*b* then moves from behind the first blanket cylinder 10*a* to a position above the platen 4 (time t14), and from time t14 to t15, ink is transferred between the second blanket cylinder 10*b* and the relief plate 4*a* on the platen 4, and the ink at the image area corresponding to the reverse image is removed from the blanket. During this time, the first blanket cylinder 10*a* is also moving in the same direction as the second blanket cylinder 10*b*, and is printing the image onto the first glass substrate 5*a*.

Then, from time t15 to t16, in a condition with the rotation of the second blanket cylinder 10*b* stopped and the notch 14 facing downward, the second blanket cylinder 10*b* is transported in the opposite direction (to the right in FIG. 1) by the second moving carriage 12*b*, until reaching the end of the second glass platen 6 (the right end of the frame 3), which is the position from which printing starts. Here, the time t16 at which the second blanket cylinder 10*b* is positioned at the end of the second glass platen 6, is the same time as the time t7 at which the first blanket cylinder 10*a* is returned to the initial position.

From time t0 to t11, the ink on the blanket is transferred onto the second glass substrate 6*a*, thereby printing the desired image onto the glass substrate 6*a*. While this is occurring, ink is being applied to the first blanket cylinder 10*a* at the ink application position 17. Here, the reason why the second blanket cylinder 10*b* is moved to the end of the frame 3 (the right end in FIG. 1) while the second glass substrate 6*a* is being printed to, is as follows. When the coating device 15 applies ink, there are cases where drying of the ink proceeds from the position where the ink was first applied. In such a case, preferably ink transfer begins from the position where ink was first applied. Supposing that the second blanket cylinder 10*b* is positioned at the coating device side (the left side in FIG. 1) of the glass substrate 6*a*, and then transfer is begun while moving the second blanket cylinder 10*b* to the right in FIG. 1, transfer begins from the position where the ink was applied last, and ends at the position where the ink was applied first. In order to avoid this situation, in the present embodiment, transfer from the second blanket cylinder 10*b* to the second glass substrate 6*a* begins from the right end of the frame 3.

In this manner, the first blanket cylinder 10*a* and the second blanket cylinder 10*b* each print once to the glass substrates 5*a* and 6*a*, respectively, within the same time period (time t0 to t7 for the first blanket cylinder 10*a*, and time t0 to t16 for the second blanket cylinder 10*b*).

Cleaning of the relief plate 4*a* placed on the platen 4 is performed during the time period Δt1, that is, from time t20 to t21, when transfer from the plate is not being performed.

Exchanging the glass substrate 5*a* and adjusting its alignment on the first glass platen 5 are performed during the time period Δt2 when transfer to the glass is not being performed, that is, from time t24 to t25 (=t3).

Exchanging the glass substrate 6*a* and adjusting its alignment on the second glass platen 6 are performed during the time period Δt3 when transfer to the glass is not being performed, that is from time t27 to t28.

Cleaning the heads of the coating device 15 is performed during the time period Δt4 when the coating device 15 is not applying ink, that is, from time t29 to t30.

According to the single color press 1 of the embodiment as described above, the following effects are demonstrated.

Because the first moving carriage 12*a* and the second moving carriage 12*b* are provided independently, the blanket cylinder 10*a* (10*b*) can be moved without being restricted by the movement of the other blanket cylinder 10*b* (10*a*), so as to transfer the image to the corresponding glass substrate 5*a* or 6*a* to effect printing. Because in this manner one blanket cylinder 10*a* does not move together with the other blanket cylinder 10*b*, wasteful operation of the blanket cylinders 10*a* and 10*b* can be almost completely eliminated. Accordingly, takt time can be shortened even more.

Furthermore, by independently providing the moving carriages 12*a* and 12*b*, even if one of the moving carriages is stopped, printing can continue by means of the other moving carriage. Moreover, because tasks like maintenance of the moving carriage or replacing the blanket can be performed while the other moving carriage continues to operate, printing can be performed efficiently.

Furthermore, by providing one blanket cylinder on each moving carriage, the blanket cylinders can be accessed from all directions, which is not possible when two blanket cylinders are provided for one moving carriage, and this enables a variety of accessories to be fitted around the blanket cylinder.

Because one platen 4 and one relief plate 4*a* are provided, and the platen 4 and the relief plate 4*a* are used in common by the first blanket cylinder 10*a* and the second blanket cylinder 10*b*, printing can be performed to two glass substrates 5*a* and 6*a* by one set of the platen 4 and the relief plate 4*a*. Accordingly, the equipment cost can be reduced compared to a case when two sets of a platen 4 and a relief plate 4*a* are provided for the respective glass substrates 5*a* and 6*a*.

In addition, because only one platen 4, one alignment adjusting device for the platen 4, and one plate cleaning device are required, the equipment cost can be further reduced.

Because the second blanket cylinder 10*b* moves continuously from behind the first blanket cylinder 10*a* to the position of the relief plate 4*a*, the removal of the reverse image by the relief plate 4*a* can be performed without any wasted time.

Because the relief plate 4*a* removes the reverse image from the second blanket cylinder 10*b* while the first blanket cylinder 10*a* is transferring the image to the first glass substrate 5*a*, the printing process can proceed without any waste of time, and takt time can be shortened.

The present embodiment can be subjected to the following modifications.

As indicated by the two-dot chain lines in FIG. 1, the ends of the frame 3 can be extended further. That is, a first extension 3*a* is provided outside the first glass platen 5, and a second extension 3*b* is provided outside the second glass platen 6. Providing the extensions 3*a* and 3*b* enables the moving carriages 12*a* and 12*b* to travel out onto these extensions 3*a* and 3*b*. As a result, the moving carriages 12*a* and 12*b* can be moved away from above the glass platens 5 and 6, enabling more flexibility in setting the time span for replacing the glass substrates 5*a* and 6*a*.

Figure 3:
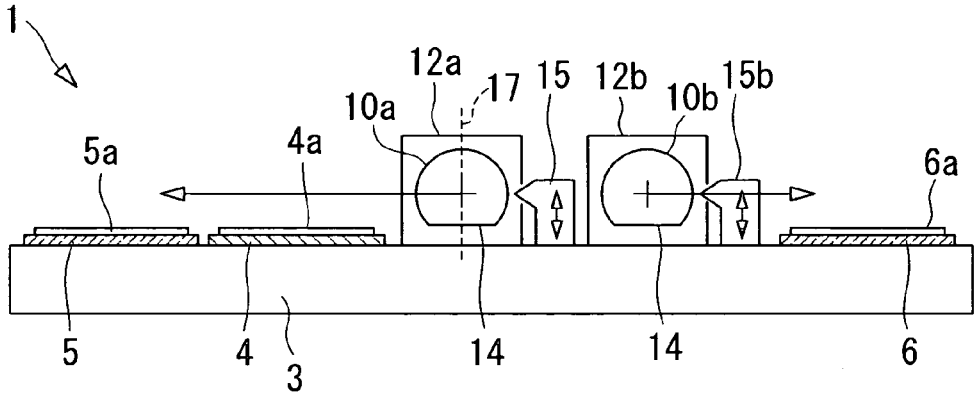
FIG. 3 is a front view showing a modification of the single color press shown in FIG. 1.

Furthermore, the present embodiment can be subjected to the modifications shown in FIG. 3.

That is to say, an additional dedicated coating device 15*b* can be provided for the second blanket cylinder 10*b*. Consequently, when applying ink to the second blanket cylinder 10*b*, there is no need to wait for the first blanket cylinder 10*a* to move away from the ink application position, and hence the time for applying ink to the second blanket cylinder 10*b* can be freely set.

Moreover, the position where ink is applied by the coating device 15 is not limited to the position beside the blanket cylinders 10*a* and 10*b* as in the embodiment, and may be above or below the blanket cylinders 10*a* and 10*b*.

Furthermore, the printing substrates are not limited to the glass substrates 5*a* and 6*a*, and the present invention can be applied to other printing media such as a ceramic plate or film.

Moreover, the plate need not be the relief plate 4*a*, and a planographic or intaglio plate such as a PS plate may be used.

Furthermore, regarding the operation of the moving carriages, instead of that shown in FIG. 2, the operations may be appropriately combined so as to minimize tact time.

SECOND EMBODIMENT

Next, a second embodiment of the present invention is described with reference to FIG. 4 and FIG. 5.

The present embodiment has in common with the first embodiment the point that a blanket cylinder is provided on each of the moving carriages, but differs in the placement of the platens, and the movement of the moving carriages.

Figure 4:
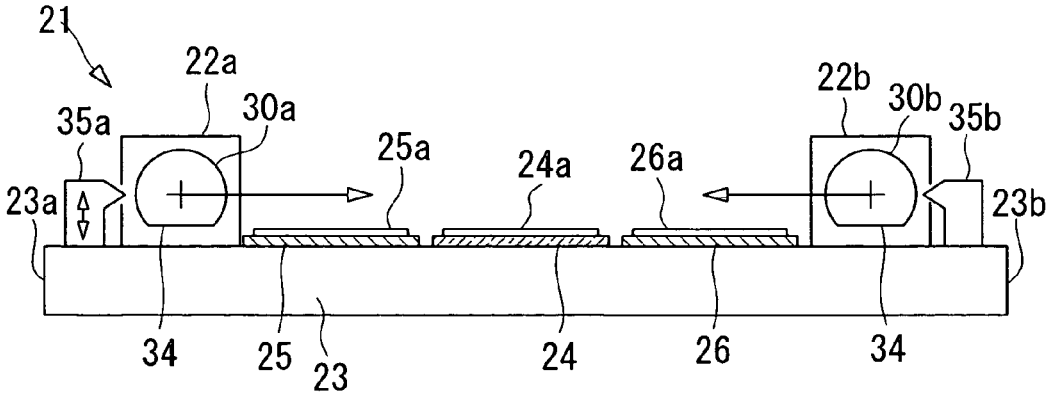
FIG. 4 is a front view showing an overview of a single color press according to a second embodiment of the present invention.

FIG. 4 shows a front view of a single color press 21. The single color press 21 prints an identical image of the same color and shape onto a plurality of printing substrates. The single color press 21 of the present embodiment is a flatbed press.

The single color press 21 mainly comprises; a frame 23 having a flat bed in a horizontal plane, three platens 24, 25 and 26 mounted on this flat bed, two blanket cylinders (transfer cylinders) 30*a* and 30*b*, two moving carriages 22*a* and 22*b* which support these blanket cylinders 30*a* and 30*b* in a rotatable manner, and two coating devices 35*a* and 35*b* which apply ink to the blanket cylinders 30*a* and 30*b*.

The frame 23 is secured onto a floor, and extends in the printing direction (the longitudinal direction in the figure). Running rails are provided along the longitudinal direction on both sides of the frame 23, and the moving carriages 22*a* and 22*b* move back and forth along these running rails in the printing direction.

At the opposite ends of the frame 23, a first stop section 23*a* (on the left in the figure) is provided which becomes the position where the first blanket cylinder 30*a* waits before and after starting printing and where ink is applied to the first blanket cylinder 30*a* before starting printing, and a second stop section 23*b* (the right in the figure) is provided which becomes the position where the second blanket cylinder 30*b* waits before and after starting printing and where ink is applied to the second blanket cylinder 30*b* before starting printing.

The three platens 24, 25 and 26 comprise; one glass platen (printing platen) 24, a first platen 25 (to the left in the figure), and a second platen 26 (to the right in the figure), provided adjacent to the glass platen 24 on either side (in the traveling direction of the moving carriages 22*a* and 22*b*) with a space for a predetermined gap.

The glass platen 24 is a flat plate, on top of which is mounted a glass substrate (printing substrate) 24*a*. The glass substrate 24*a* is positioned to match with markers formed on the upper surface of the glass platen 24.

The first and second platens 25 and 26 are flat plates, on top of which are mounted relief plates (printing plates) 25*a* and 26*a*. The relief plates 25*a* and 26*a* are positioned to match with markers formed on the upper surfaces of the platens 25 and 26. A reverse image which is the reverse of the desired final image, is formed on the surfaces of the relief plates 25*a* and 26*a*. For the reverse image formed on the relief plates 25*a* and 26*a*, one which is the same shape is used. As described below, relief portions formed to correspond with the reverse image, remove the ink from the blankets of the blanket cylinders 30*a* and 30*b*, the entire surfaces of which are coated with ink.

The two moving carriages 22*a* and 22*b* are provided on the frame 23, and travel upon the frame 23 in the printing direction (the longitudinal direction in the figure). Before the ink is applied, the moving carriages 22*a* and 22*b* wait at the first stop section 23*a* and the second stop section 23*b* 4 at the opposite ends of the frame 23, as shown in FIG. 4.

On the first moving carriage 22*a*, a first blanket cylinder 30*a* is provided in a rotatable manner, and on the second moving carriage 22*b*, a second blanket cylinder 30*b* is provided in a rotatable manner.

The blanket cylinders 30*a* and 30*b* are provided so that their axes of rotation are orthogonal to the traveling direction of the moving carriages 22*a* and 22*b*, and they roll over the glass substrate 24*a* and the relief plates 25*a* and 26*a* with travel of the moving carriages 22*a* and 22*b*.

On the blanket cylinders 30*a* and 30*b*, as shown in FIG. 4, are provided notches 34 where a portion is notched along the longitudinal direction. In these notches 34 is provided securing sections (not shown) which secure the opposite ends of the blankets wound around the blanket cylinders 30*a* and 30*b*. These notches 34 provide leeway so that when the blanket cylinders 30*a* and 30*b* pass over the glass platen 24 and the printing platens 25 and 26 without transferring an image, they can pass without coming into contact with the platens 24, 25 and 26.

Two coating devices 35*a* and 35*b* are provided at opposite ends of the frame 23. The first coating devices 35*a* applies ink from the side to the first blanket cylinder 30*a*, and the second coating devices 35*b* applies ink from the side to the second blanket cylinder 30*b*. During the period when ink is not being applied, the coating devices 35*a* and 35*b* are stowed by moving downward to a level lower than the upper surface of the frame 23, and move upward to the position shown in FIG. 4 only when applying ink.

Figure 5:
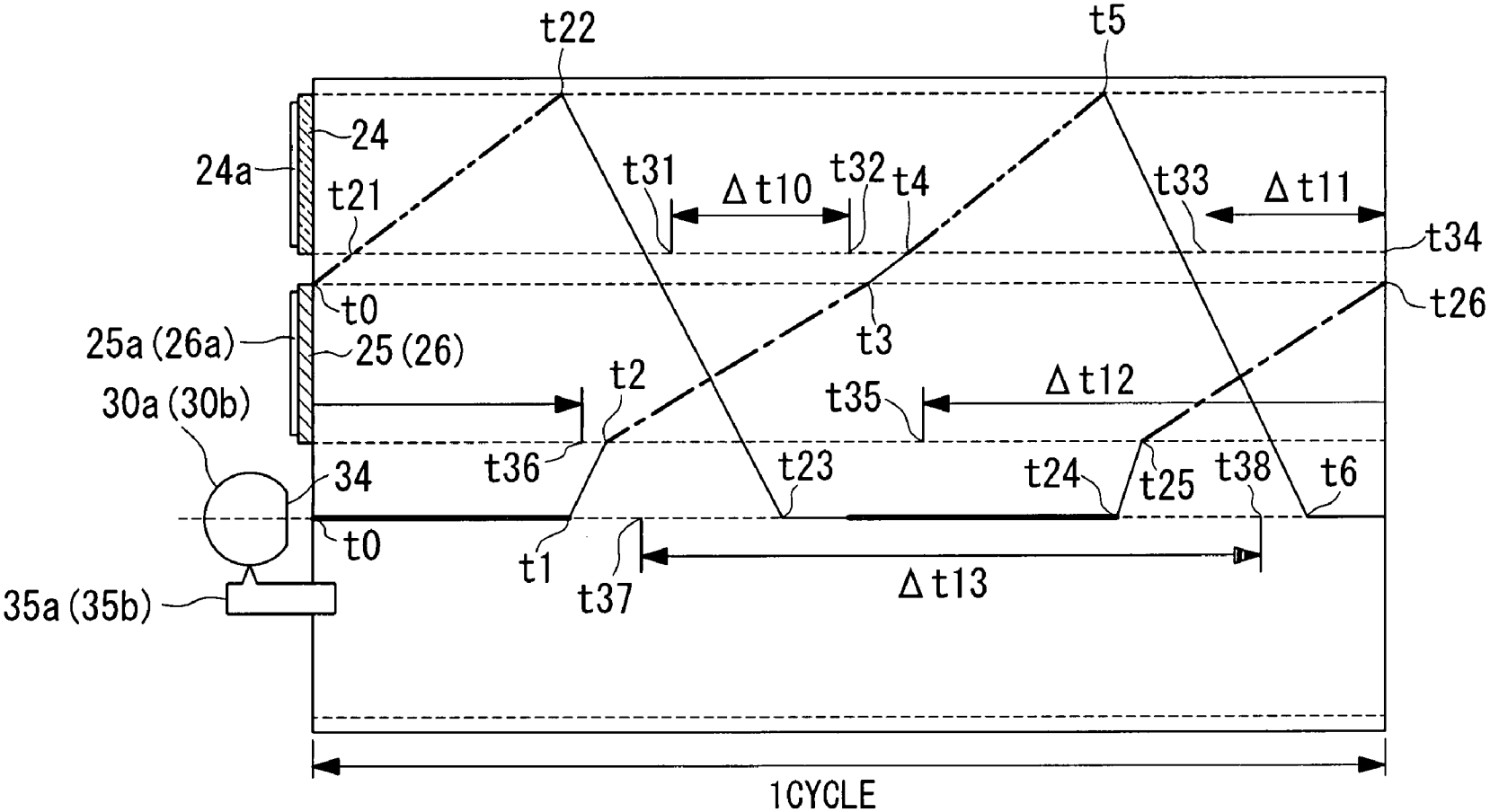
FIG. 5 is a time chart showing a method of operating the single color press shown in FIG. 4.

Next, the operation of the single color press 21 with this construction is described using FIG. 5.

In FIG. 5, the horizontal axis indicates time, and the vertical axis indicates position. The vertical axis shows the position of the platens 25 (26) and 24, the blanket cylinders 30*a* (30*b*), and the coating devices 35*a* (35*b*). Note that in FIG. 5, only one of the set of blanket cylinder, platen and coating device is shown.

First, the movement of the first blanket cylinder 30*a* is described.

From time t0 to t1, the coating device 35*a* applies ink to the entire surface of the blanket.

Then from time t1 to t2, the first blanket cylinder 30*a* moves to a position above the first platen 25, and ink transfer between the first blanket cylinder 30*a* and the first relief plate 25*a* upon the first platen 25 is performed, removing from the blanket, the ink at the image area corresponding to the reverse image.

After transfer between the first blanket cylinder 30*a* and the first relief plate 25*a* is completed during the period from time t2 to t3, the first blanket cylinder 30*a* then moves to a position above the glass platen 24 (time t4).

From time t4 to t5, the ink on the blanket is transferred onto the glass substrate 24*a*, thereby printing the desired image onto the glass substrate 24*a*. Subsequently, the first blanket cylinder 30*a* moves in the opposite direction, returning to the initial position at time t6.

Next, the movement of the second blanket cylinder 30*b* is described in relation to the movement of the first blanket cylinder 30*a*.

The second blanket cylinder 30*b* differs from the first blanket cylinder 30*a* in the point that the directions of travel are opposite, but otherwise the transfer process between the second blanket cylinder 30*b* and the relief plate and glass substrate do not differ. However, the timing of the transfer between the blanket cylinders and the relief plate and the glass substrate is offset to prevent the blanket cylinders from interfering with each other above the common glass platen 24. That is, the time period when the second blanket cylinder 30*b* is transferring to the glass substrate 24*a* (from time t21 to t22), and the time period when the first blanket cylinder 30*a* is transferring to the glass substrate 24*a* (from time t4 to t5) are offset.

The exchange and alignment of the glass substrate 24*a* are performed during the time period Δt10 from time t31 to t32, and the time period Δt11 from time t33 to t34. In the present embodiment, because a common glass platen 24 is used, the time period for the exchange and alignment of the glass substrate 24*a* tends to be small. Accordingly, it is necessary to adjust the offset time between the first blanket cylinder 30*a* and the second blanket cylinder 30*b*.

Alignment adjustment of the glass platen 24 is performed as follows.

When the glass substrate 24*a* to which printing is performed by the first blanket cylinder 30*a* is mounted on the glass platen 24, alignment adjustment is performed on the glass platen 24 with respect to the first printing platen 25. On the other hand, when the glass substrate 24*a* to which printing is performed by the second blanket cylinder 30*b* is mounted on the glass platen 24, alignment adjustment is performed on the glass platen 24 with respect to the second printing platen 26. Switching between the subject of alignment is performed whenever the next glass substrate 24*a* is mounted on the glass platen 24, based on instructions to the alignment adjusting device from a control section (not shown).

Furthermore, instead of this alignment method, the following modifications are also possible.

Alignment of the glass platen 24 is matched with the alignment of the first and second platens 25 and 26.

Specifically, after first performing alignment adjustment of the glass platen 24 with respect to the first platen 25, alignment adjustment of the second platen 26 is then performed so as to conform to the alignment of the glass platen 24. As a result, alignment adjustment of the glass platen 24 each time the glass substrate 24*a* is placed is unnecessary, and the time required to exchange the glass substrate 24*a* can be shortened.

Adequate time can be secured to clean the plates (for example for the first blanket cylinder 30*a*, the time period Δt12 from time t35 to t36), and to clean the heads of the coating device 35*a* (35*b*) (for example for the first blanket cylinder 30*a*, the time period Δt13 from time t37 to t38), because the printing platen 25 and 26 and the coating device 35*a* and 35*b* are independent1y provided for each of the blanket cylinders 30*a* and 30*b*.

According to the single color press 21 of the embodiment as described above, the following effects are demonstrated.

Because the first moving carriage 22*a* and the second moving carriage 22*b* are provided independently, the blanket cylinder 30*a* (30*b*) can be moved without being restricted by the movement of the other blanket cylinder 30*b* (30*a*), so as to transfer the image to the corresponding glass substrate 24*a* to effect printing. Because in this manner one blanket cylinder 30*a* does not move together with the other blanket cylinder 30*b*, wasteful operation of the blanket cylinders 30*a* and 30*b* can be almost completely eliminated. Accordingly, takt time can be shortened even more.

Furthermore, by independently providing the moving carriages 22*a* and 22*b*, even if one of the moving carriages is faulty, printing can continue at the other moving carriage. Moreover, because tasks like maintenance of the moving carriage or replacing the blanket can be performed while the other moving carriage continues to operate, printing can be performed efficiently.

Furthermore, by providing one blanket cylinder on each moving carriage, the blanket cylinders can be accessed from all directions, which is not possible when two blanket cylinders are provided for one moving carriage, and this enables a variety of accessories to be fitted around the blanket cylinder.

Because the glass substrate 24*a* to which printing is performed by the first blanket cylinder 30*a*, and the glass substrate 24*a* to which printing is performed by the second blanket cylinder 30*b* are placed on the same glass platen 24, only one device for handling the glass substrate 24*a*, and one alignment adjusting device for the glass platen 24 are required. As a result, equipment cost can be reduced Furthermore, because the first platen 25 and the second platen 26 are provided on either side of the glass platen 24, the first moving carriage 22*a* and the second moving carriage 22*b* can access the relief plates 25*a* and 26*a* from both sides, and the carriages do not interfere with each other. Accordingly, takt time can be shortened.

Because the alignment of the glass platen 24 is different for each platen 25 and 26, adjustment is to the alignment of the platen 25 and 26 corresponding to the glass substrate 24*a* to which transfer is next performed. This enables precise printing.

The position where ink is applied by the coating device 35*a* and 35*b* is not limited to the position beside the blanket cylinders 30*a* and 30*b* as in the embodiment, and may be above or below the blanket cylinders 30*a* and 30*b*.

Furthermore, the printing substrate is not limited to the glass substrate 24*a*, and the present invention can be applied to other printing media such as a ceramic plate or film.

Moreover, the plate need not be the relief plates 25*a* and 25*b*, and a planographic or intaglio plate such as a PS plate may be used.

Furthermore, regarding the operation of the moving carriages, instead of that shown in FIG. 5, the operations may be appropriately combined so as to minimize tact time.

What is claimed is:

1. A single color press comprising:

a first transfer cylinder which transfers an image to a first printing substrate;

a first moving carriage which holds said first transfer cylinder in a rotatable manner and travels along a frame;

a second transfer cylinder which transfers an image of the same color and shape as that of said image to a second printing substrate; and a second moving carriage which holds said second transfer cylinder in a rotatable manner and travels along said frame.

2. A single color press according to claim 1, comprising;

a first plate which removes a reverse image from said first transfer cylinder, and a second plate which removes a reverse image from said second transfer cylinder, and said first printing substrate and said second printing substrate are placed on a common printing platen during printing, and said first plate and said second plate are respectively provided on either side of said printing platen.

3. A single color press according to claim 2, wherein when transferring to said first printing substrate, alignment adjustment of said first plate is performed with respect to said printing platen, and when transferring to said second printing substrate, alignment adjustment of said second plate is performed with respect to said printing platen.

4. A single color press according to claim 2, wherein the alignment of said second plate is adjusted so as to match the alignment of said printing platen with respect to said first plate.

* * * * *